US008505920B1

(12) United States Patent
Slifker

(10) Patent No.: US 8,505,920 B1
(45) Date of Patent: Aug. 13, 2013

(54) COUNT DOWN GAME

(76) Inventor: Michael Slifker, Orlando, FL (US)

( * ) Notice: Subject to any disclaimer, the term of this patent is extended or adjusted under 35 U.S.C. 154(b) by 835 days.

(21) Appl. No.: 12/477,024

(22) Filed: Jun. 2, 2009

(51) Int. Cl.
*A63F 1/00* (2006.01)

(52) U.S. Cl.
USPC ..... 273/303

(58) Field of Classification Search
USPC ..... 273/292
See application file for complete search history.

(56) References Cited

U.S. PATENT DOCUMENTS

| | | | | |
|---|---|---|---|---|
| 4,651,997 | A | 3/1987 | Wood | |
| 4,659,087 | A | 4/1987 | Shen | |
| 5,072,946 | A | 12/1991 | Miller | |
| 5,324,041 | A | 6/1994 | Boylan | |
| 5,529,309 | A | 6/1996 | Bartlett | |
| 5,895,047 | A | 4/1999 | Callaban | |
| 5,928,081 | A * | 7/1999 | Bochichio et al. | 463/13 |
| 6,012,720 | A * | 1/2000 | Webb | 273/292 |
| 6,402,149 | B1 | 6/2002 | Chou | |
| 6,439,573 | B1 * | 8/2002 | Sklar | 273/292 |
| 6,585,588 | B2 * | 7/2003 | Hartl | 463/16 |
| 6,626,433 | B2 | 9/2003 | Scibetta | |
| 7,168,705 | B2 | 1/2007 | Schibetta | |
| 7,185,891 | B2 * | 3/2007 | Jackson | 273/292 |
| 7,338,371 | B2 | 3/2008 | Cheng | |
| 2002/0137558 | A1 | 9/2002 | Hartl | |
| 2003/0155713 | A1 * | 8/2003 | Jones et al. | 273/292 |
| 2004/0227294 | A1 | 11/2004 | Au-Yeung | |
| 2005/0059448 | A1 | 3/2005 | Sims | |
| 2005/0275167 | A1 | 12/2005 | Wilson | |
| 2007/0040333 | A1 * | 2/2007 | Au-Yeung | 273/292 |
| 2007/0290443 | A1 | 12/2007 | Lemberg | |
| 2008/0290600 | A1 | 11/2008 | Simpson | |
| 2009/0267301 | A1 * | 10/2009 | Au-Yeung | 273/292 |

* cited by examiner

*Primary Examiner* — Kurt Fernstrom
*Assistant Examiner* — Dolores Collins
(74) *Attorney, Agent, or Firm* — QuickPatents; Kevin Prince

(57) ABSTRACT

The present teachings relate to a novel game of chance for use in existing table game formats, for example, in live casinos, in video games, and in computer/animated game playing software. The method comprises playing a game with at least one player and a dealer using at least one deck of conventional playing cards, each card ranked from lowest to highest as Ace, 2, 3, 4, 5, 6, 7, 8, 9, 10, Jack, Queen, King. The player is declared the winner if the player has a card lower in rank than the dealer's most recently dealt card, or if the dealer busts.

22 Claims, 4 Drawing Sheets

COUNT DOWN GAME

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to a game of chance, and more particularly to a game that can be is played at a casino table card game or at a video casino station.

DISCUSSION OF RELATED ART

The casino industry is built on games of chance. In an effort to grow and maintain player interest, casinos desire to obtain new games. Casino table games consist of traditional games, for example, blackjack, war, baccarat, poker, and Caribbean stud, all of which can be played with a deck or multiple decks of a conventional deck of 52 cards. New games and variants of existing games have been added regularly for variety and stimulation. The benefits of these games include the fact that any number of players can play games either against the dealer's hand or against other players at the table. Even single players may play some of these games, with or without a dealer hand. With the increase in technology, casino games can now be played from the comfort of home through the use of a computer and the internet.

Exemplary table games of chance include the game Keep 'Em Coming that is described in U.S. Pat. No. 7,185,891 B2, to Jackson on Mar. 6, 2007. The object of Keep 'Em Coming is for a player to end up with more cards than a dealer. A player can continue to take cards from a dealer, up to 6 cards. Each card taken must be higher in rank than the previous card, otherwise the player busts out. The dealer must continue to take cards until the dealer reaches 6 cards, or at least one more card than the players at the table. If the dealer draws a card that is not higher in rank than the previous card, the dealer busts out. When the dealer busts, the dealer counts the number of cards taken before the bust out and compares them to how many cards each player at the table took. If a player has taken more cards than the dealer has, the player wins. If they player has not taken more cards than the dealer has, the player loses. Player payouts are more for the more cards a player has verses the number of cards that the dealer has.

U.S. Pat. No. 7,168,705 B2 to Schibetta, on Jan. 30, 2007, describes a variant of a high card game. A player first places a bet, preferably in a betting spot using chips. Next, the dealer deals a predetermined number of cards to each player face down onto an area on the table called a pot designated for that player, for example 6 cards. Afterwards, the dealer deals the same number of cards to another area on the table, called a dealer's pot. One play in a series includes the dealer turning up a player's top card and turning up the dealer's top card, where the high card wins, equal cards are a draw or push and neither wins except if a player has a deuce or an ace. If the tie is between two deuces, the player's deuce loses 1 to 1 odds. If the tie is between aces, the player's ace wins at odds of 3 to 2. After one play, a player may place a new bet before cards are next turned over.

U.S. Pat. No. 7,338,371 B2 to Cheng et al., on Mar. 4, 2008, describes a variant of a high-low table game. In this game, a player predicts whether the next value in a series of values is higher or lower than the current value. The payouts for a correct choice of higher than can differ from the payouts for a correct choice of lower than. After each successful high or low prediction, the player is rewarded. The player must then elect to either cash out or parlay the player's balance into the next prediction. The player can decide to parlay his winnings or remove the winnings and start with a fresh bet. After an unsuccessful prediction, the amount wagered during that hand is lost and the game session is concluded.

U.S. Pat. No. 5,072,946 to Miller, on Dec. 17, 1991, describes a variation on the classic game of baccarat. The game utilizes one or more decks of cards. One card is dealt to a first player and one card is dealt to a second player. The numerical value of the first player's card is compared to the numerical value of the second player's card. If the numerical values are the same, the game is over and the deal is declared a tie. If the numerical value of the first player's hand is not the same as the value of the second player's hand, another card is dealt to the player having the lower numerical value. Again the total numerical values are compared. If a tie now exists, the game is over and the hand is declared a tie. The dealing of cards to the hand having the lower total numerical value continues until a tie exists or until one of the hands exceeds a predetermined value. Once one of the hands exceeds the predetermined value, the other hand wins. In one variation of this game, any time one of the hands achieves the exact predetermined numerical value, the game ends with that hand being declared the winner. Players can wager on whether the first player's hand, the second player's hand or the tie will win.

Count-Down, as described herein, is a novel game of chance and skill for use in existing table game formats, for example, in live casinos, in video games, and in computer/animated game playing software. Just like the games mentioned above, Count-Down can be played using a conventional deck of 52 playing cards. The object of the game is to have a lower ranked card than your opponent, at the end of the hand. A player can also win if the opponent busts while the player is still in the hand.

SUMMARY OF THE INVENTION

The present teachings relate to a method that embodies a novel game of both chance and skill that can be used with a conventional deck of 52 playing cards. The method can be played on existing table game formats, for example, in live casinos, in video games, and in computer/animated game playing software.

According to various embodiments of the present teachings, a method for playing a game with at least one player and a dealer using at least one deck of conventional playing cards, is described. The cards are ranked from lowest to highest as Ace, 2, 3, 4, 5, 6, 7, 8, 9, 10, Jack, Queen, King, with King being ranked the highest at 13. In some embodiments the method comprises dealing a card to a dealer and to multiple players. The method can comprise various steps. Step (a) comprises dealing at least one player and a dealer each a first card from the deck to form a player's hand and a dealer's hand, respectively, at least the dealer's first card being dealt face-down. In some embodiments, the method comprises a step of each player placing a bet up to a maximum bet, before the cards are dealt. Step (b) comprises receiving a decision from the player to either receive an additional card from the deck or to stay with the cards in his hand. Step (c) comprises, if in step (b) the player asks to receive an additional card, dealing the player the additional card from the deck, otherwise, if the player stays, advancing to step (e).

Step (d) comprises if the player's additional card is the same rank as the player's previous most recently dealt card, advancing to step (e), otherwise if the player's additional card is higher in rank than the player's previous most recently dealt card, declaring the player's hand a bust and the dealer the winner, and stopping play, otherwise if the player's additional card is lower in rank than the player's previous most recently dealt card, repeating from step (b). Step (e) comprises if the dealer's first card is face down, turning it face up. Step (f) comprises if the dealer's most recently dealt card is lower in rank than the player's most recently dealt card, declaring the dealer the winner and stopping play, otherwise if the dealer's most recently dealt card is equal in rank to the player's most recently dealt card, declaring the game a push and stopping play. Step (g) comprises dealing the dealer an additional card from the deck if the dealer's most recently dealt card is above a threshold rank, otherwise advancing to step (i).

Step (h) comprises if the dealer's additional card has the same rank as the dealer's previous most recently dealt card, advancing to step (i), otherwise if the dealer's additional card is higher in rank than the dealer's previous most recently dealt card, declaring the dealer's hand a bust and the player the winner, and stopping play, otherwise if the dealer's additional card is lower in rank than the dealer's previous most recently dealt card, repeating from step (f). Step (i) comprises if the player's most recently dealt card is lower than the dealer's most recently dealt card, declaring the player the winner and stopping play, otherwise if the dealer's most recently dealt card is the same rank as the player's most recently dealt card, declaring the game a push and stopping play, otherwise if the dealer's most recently dealt card is lower in rank than that of the player's most recently dealt card, declaring the dealer the winner and stopping play.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

Figure 1:
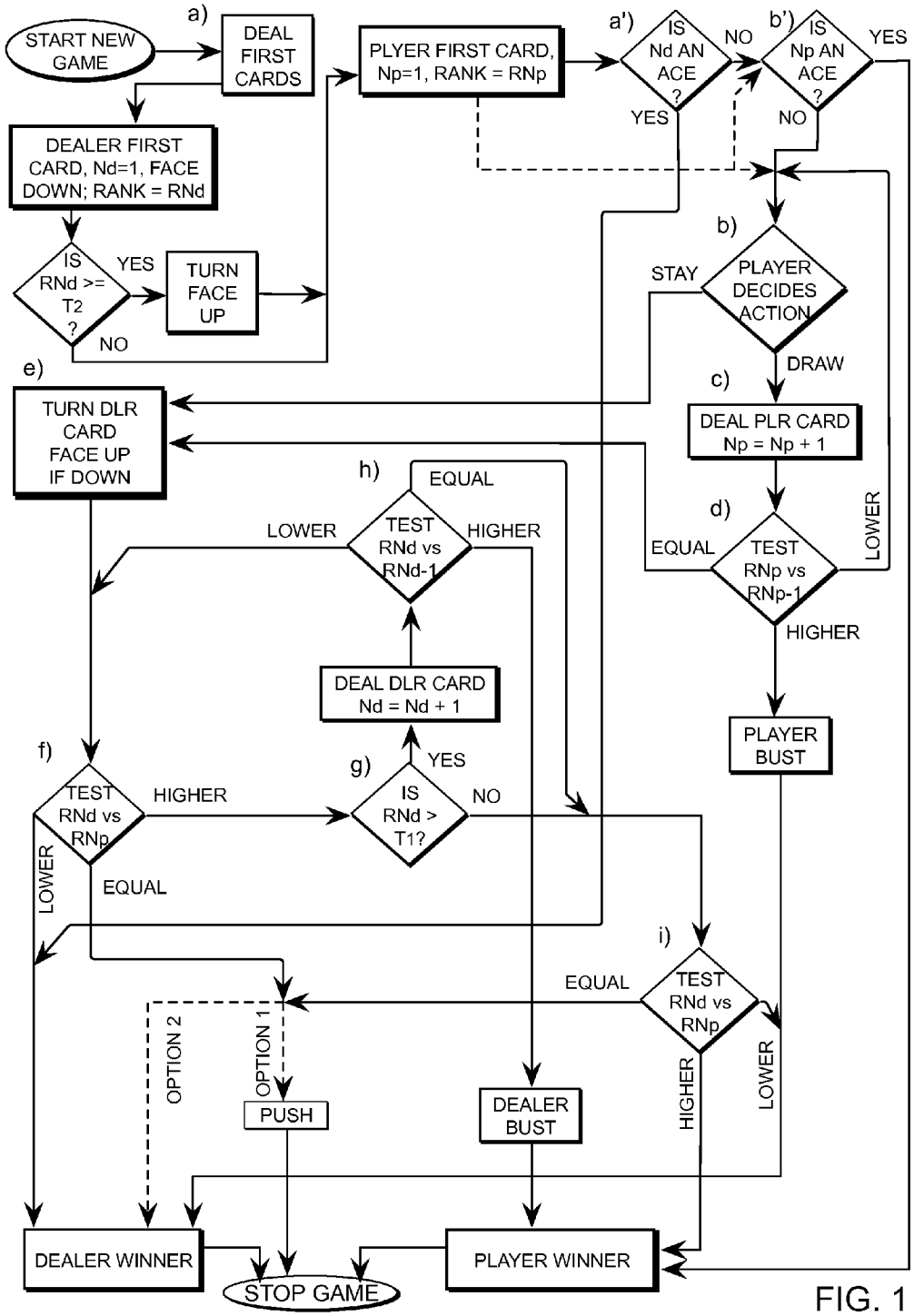
FIG. 1 is a flow chart of a method according to various embodiments, the method comprising dealing a first card to a player and to a dealer to form a player's hand (Np) and a dealer's hand (Nd)

According to various embodiments, a method is provided for playing a game with one or more players and a dealer. The method can be used with at least one deck of conventional playing cards, for example, a 52 card deck, wherein each card ranks from lowest to highest as Ace, 2, 3, 4, 5, 6, 7, 8, 9, 10, Jack, Queen, and King. In some embodiments, the Ace can also hold the highest rank, above King. To win the game, the player must have a lower last card than the dealer's last card, or the player must be in the hand when the dealer busts. Before each new deal, a player can have the option of betting a number amount of his or her choosing, optionally up to a maximum bet. The method can comprise the steps of (a), (b), (c), (d), (e), (f), (g), (h), and (i), as illustrated in FIG. 1.

Step (a) comprises a dealer dealing a player and the dealer each a first card from a standard deck of 52 playing cards to form a player's hand and a dealer's hand, respectively. The player's most recently dealt card is represented by the symbol (Np), as shown in FIG. 1. The dealer's first card can be dealt face-down. The dealer's most recently dealt card is represented by (Nd). In some embodiments, if the dealer's card is equal to or above a second threshold rank represented by ($T_2$), for example, rank 6, 7, 8, 9, or 10, the dealer flips the dealer's card over for the player to see, before the method advances to step (b). Being able to see the dealer's card can help the player determine if he should take an additional card or if he would like to stay with the cards that he has. In some embodiments, the method can comprise the step of (a'). The step of (a') can be determining if the player's most recently dealt card is an ace, and if so, declaring the player the winner and stopping play. The step of (a') can also optionally be determining if the dealer's most recently dealt card is an ace, and if so the method can declare the dealer the winner and play can stop. The step of (a') may also be a combination of these options, the dealer's hand being checked for an ace first, as illustrated in FIG. 1.

In some embodiments, if the player's first card is an ace, the step of (a') can provide the player the option to take even winnings, or the player can elect to take another card and continue on, and the Ace will be counted as the highest rank of 14. If a player decides to continue on with the Ace having a rank that is counted as 14, the player can win more than his bet, for example, a multiplier such as 150%, 200%, or 300% of their bet. If the dealer is dealt a first card Ace, the dealer can be declared the automatic winner, regardless of what the player's card is. In some embodiments, if the dealer's first card is an Ace and the player's first card is an ace, the player can be declared the winner, the dealer can be declared the winner, the hand can be declared a draw or a "push," or the player receive a portion of their bet back, for example, if a player bets 100, and both the dealer and the player are dealt a first card Ace, the player can get back 50 of the 100 bet, thus losing half the player's bet.

Step (b) comprises the dealer receiving a decision from the player to either receive an additional card (Np+1) from the deck or to stay with the cards in the player's hand. Step (c) comprises dealing the player a new card. If in step b) the player asks to receive an additional card, the method further comprises dealing the player the additional card from the deck. If the player declines a new card, then the player stays, and the method advances to step (e).

Figure 4A:
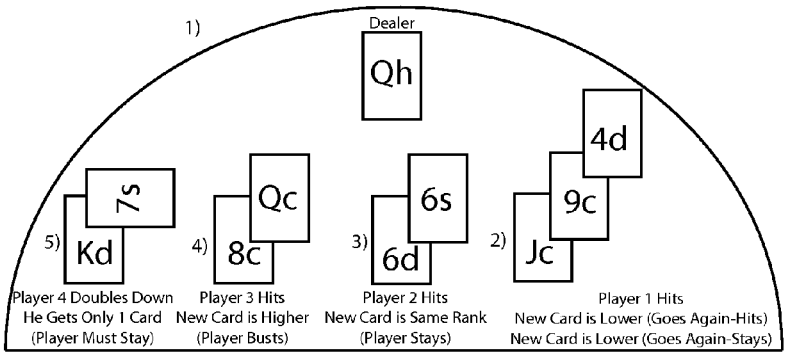
FIG. 4A is a sample diagram of cards on a playing surface, illustrating a possible dealer hand and several possible player hands during a multi-player game of the method.
Figure 4B:
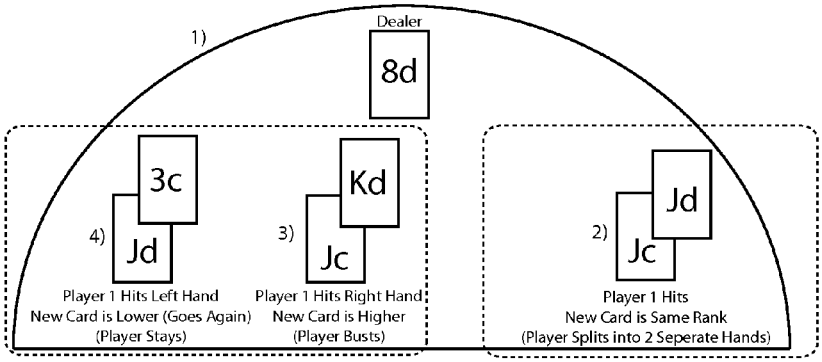
FIG. 4B is a sample diagram of cards on the playing surface, illustrating the process of a player splitting one hand into two separate hands.
Figure 4C:
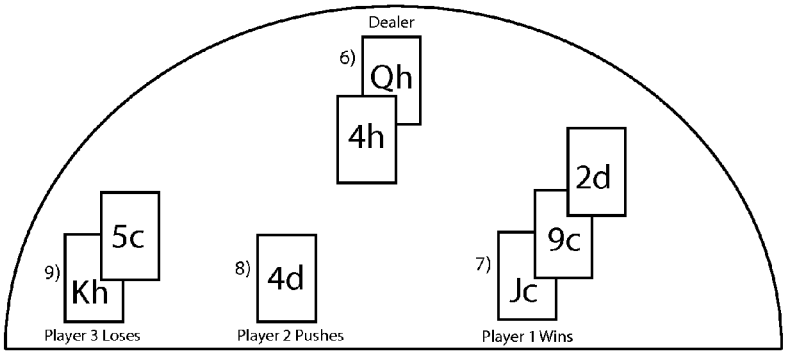
FIG. 4C is a sample diagram of cards on the playing surface, illustrating a possible dealer hand and several possible player outcomes during a multi-player game of the method.

If in step (c) the player decides to take an additional card, step (d) comprises comparing the rank of the player's additional card (RNp) to the rank of the player's previous most recently dealt card (RNp−1). If the player's new card is the same rank as the player's previous most recently dealt card, the method can advance to step (e). In some embodiments, if the player's additional card is equal to the player's previous most recently dealt card, the player can choose to receive an additional card, or the player can choose to split the two cards into two hands (FIG. 4B). If the player chooses to split the two cards, the player can repeat steps (b)-(d) for each of the hands. If the player chooses to split the cards, the game can require that the player double his or her bet. When a player decides to split two cards, each card can be played separately and independently from the other card. By splitting a hand, the player can effectively turn one hand into two separate hands, each played independently from each other.

In step (d), if the player's additional card is higher in rank than the player's previous most recently dealt card, the method comprises declaring the player's hand a bust and declaring the dealer the winner, and stopping play. For example, if the player's previous most recently dealt card is a 7, and the player's additional card is a 10, the method declares the player's hand a bust. If the player's additional card is lower in rank than the player's previous most recently dealt card, then the method repeats step (b). For example, if the player's most recently dealt card is a Jack, and the player's additional card is a 7, then the player again has the opportunity to decide whether to take another additional card, or to stay. This process repeats itself until the player stays or until the player busts.

If the player stays, and the player has not busted, the method continues to step (e). In step (e) if the dealer's first card is face down, the method comprises turning the dealer's first card face up. Step (f) comprises determining if the rank of the dealer's most recently dealt card (RNd) is lower in rank than the rank of the player's most-recently dealt card (RNp). If the dealer's most recently dealt card is lower in rank than the player's most recently dealt card, the method comprises declaring the dealer the winner and stopping play. For example, if the dealer's most recently dealt card is a 5 and the player's most recently dealt card is an 8, the dealer is declared the winner. If the dealer's most recently dealt card is equal in rank to the player's most recently dealt card, the method can comprise declaring the game a push, declaring the dealer the winner, declaring the player the winner, or returning the player a portion of their bet, and then stopping play. If the dealer's most recently dealt card is higher in rank than the player's most recently dealt card, the method advances to step (g) that comprises dealing the dealer an additional card from the deck (Nd+1).

In some embodiments, step (g) provides that the dealer is only dealt an additional card if the dealer's most recently dealt card is above a threshold rank (T1). The threshold rank can be any desired number, for example, 4, 5, 6, 7, or other desired threshold rank. In an exemplary embodiment, the threshold rank is 5. The player's most recently dealt card is a 3, and the dealer's most recently dealt card is a 4. In such an example, even though the dealer's card is higher in rank than the player's most recently dealt card, because the dealer's card is below the threshold rank of 5, the dealer is forced to stay, and the method advances to step (i). In such an embodiment, step (f) is optional, and play advances to step (g) directly from step (e)

If the dealer takes an additional card, the method advances to step (h). Step (h) comprises determining if the rank of the dealer's additional card (RNd) has the same rank as the dealer's previous most-recently dealt card (RNd−1). If so the method advances to step (i). If the dealer's additional card is higher in rank than the dealer's previous most recently dealt card, the method can comprise declaring the dealer's hand a bust and the player the winner, and stopping play. For example, if the dealer's most recently dealt card is a 9 and the dealer's additional card is a King, the dealer's hand can be declared a bust. If the dealer's additional card is lower in rank than the dealer's previous most recently dealt card, the method further comprises repeating steps (f)-(h). In some embodiments, if the dealer's additional card is the same in rank as the dealer's most previously dealt card, the method requires the dealer to stay.

Once the dealer has busted, the dealer has been dealt a card that is lower in rank than the player's most recently dealt card, or the dealer has achieved a card that is below the threshold rank ($T_1$), the method advances to step (i). Step (i) comprises determining if the rank of the player's most recently dealt card (RNp) is lower than the rank of the dealer's most recently dealt card (RNd). If the player has not busted, and the player's most recently dealt card is lower in rank than the dealer's most recently dealt card, the player is declared the winner and play is stopped. If the dealer's most recently dealt card is the same rank as the player's most recently dealt card, the dealer can be declared the winner. In some embodiments, if the dealer's most recently dealt card is equal in rank to the player's most recently dealt card the game can be declared a push, the player can be declared the winner, or the player can be returned a portion of the player's bet, for example 50%. If the dealer's most recently dealt card is lower in rank than that of the player's most recently dealt card, the method comprises declaring the dealer the winner and stopping play.

Figure 2:
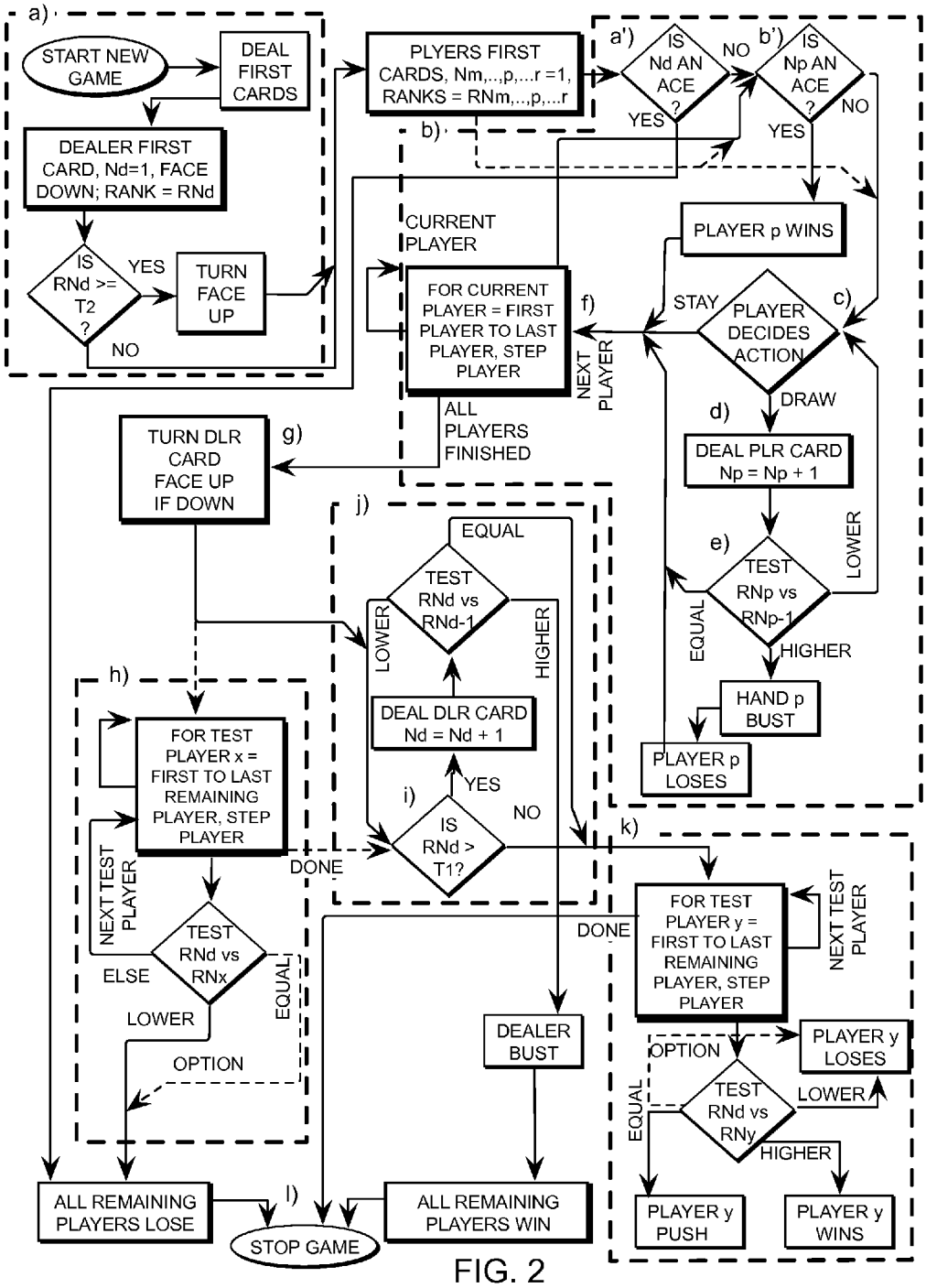
FIG. 2 is a flow chart of the method according to various embodiments, the method comprising dealing a first card to each of a plurality of players and to a dealer.

In some embodiments, the method can comprise playing a game with a plurality of players and a dealer using at least one deck of conventional playing cards, each card ranked from lowest to highest as Ace, 2, 3, 4, 5, 6, 7, 8, 9, 10, Jack, Queen, King. The method can comprise the steps of (a), (b), (c), (d), (e), (f), (g), (h), (i), (j), (k), and (l), as illustrated in FIG. 2.

Step (a) can comprise dealing each player from a first player to a last player and the dealer a first card from a deck to form each player's hand and a dealer's hand. The dealer's first card can be dealt face-down. Step (b) comprises designating the first player as the current player. Step (c) comprises receiving a decision from the current player to either receive an additional card from the deck or to stay with the cards in his or her hand. If in step (c) the current player asks to receive an additional card (Np+1), step (d) comprises dealing the current player the additional card from the deck. If in step (c) the player decides to stay, the current player stays, and the method advances to step (f). If the current player takes an additional card, step (e) comprises determining if the rank of the current player's additional card (RNp) has the same rank as the current player's previous most recently dealt card (RNp−1). If the additional card is the same rank as the player's previous most recently dealt card, the method can comprise ending the player's turn, and requiring the player to stay. In some embodiments, the player can choose to take another card and repeat steps (c)-(e). In yet other embodiments, the player can choose to split the two equally ranked cards into two independent hands and repeat steps (c)-(e) for each hand.

If the current player's additional card is higher in rank than the current player's previous most recently dealt card, step (e) comprises declaring the current player's hand a bust and the current player a loser and advancing to step (f). If the current player's additional card is lower in rank than the current player's previous most recently dealt card, the method comprises repeating from step (c).

Once the current player stays, or has busted out, the method determines if the current player is the last player. If the current player is not the last player, step (f) designates the next player the current player and the method comprises repeating from step (c). This step is repeated until the current player is the last player, and the last player has either stayed or busted out. If the dealer's first card is face down, step (g) comprises turning it face up. Step (h) comprises determining if the rank of the dealer's most recently dealt card (RNd) is lower in rank than the rank of each of the remaining non-losing players' most recently dealt cards (RNm−p). If the dealer's most recently dealt card is lower in rank than each of the remaining non-losing players' most recently dealt cards, step (h) comprises declaring the dealer the winner, declaring each remaining player a loser, and stopping play.

If the dealer's most recently dealt card is not lower in rank than the rank of all the remaining non-losing players' most recently dealt cards, the method can comprise (i) dealing the dealer an additional card from the deck (Nd+1). In some embodiments, the dealer is only dealt another card if the rank of the dealer's most recently dealt card (RNd) is above a threshold rank ($T_1$), for example, 5, 6, 7, or 8. In such an embodiment, step (h) is optional. In step (j), if the dealer's additional card has the same rank as the dealer's previous most recently dealt card, the method can comprise advancing to step (k). In some embodiments, if the dealer's additional card has the same rank as the dealer's previous most recently dealt card, the dealer can choose to take an additional card, and the method can repeat from step (h). If the dealer's additional card is higher in rank than the dealer's previous most recently dealt card, the method comprises declaring the dealer's hand a bust and each non-losing player remaining a winner, and stopping play. If the dealer's additional card is lower in rank than the dealer's previous most-recently dealt card, the method comprises repeating from step (h). The method continues until the dealer has either busted, reached a staying point either because the dealer's most recently dealt card is below the threshold rank ($T_1$), or, in some embodiments, because the dealer's most recently dealt card is lower in rank than the rank of all the remaining non-losing players' most recently dealt cards.

The method can then advance to step (k) that comprises, for each of the remaining non-losing players, if the player's most recently dealt card is lower than the dealer's most recently dealt card, declaring that player a winner and stopping play. If the dealer's most recently dealt card has the same rank as that player's most recently dealt card, the method can comprise declaring the game a push, declaring the player the winner, declaring the dealer a winner, or giving the player back a portion of the player's bet, and then stopping play. If the dealer's most recently dealt card is lower in rank than that player's most recently dealt card, the method further comprises declaring that player a loser, and then stopping play, step (l).

Figure 3:
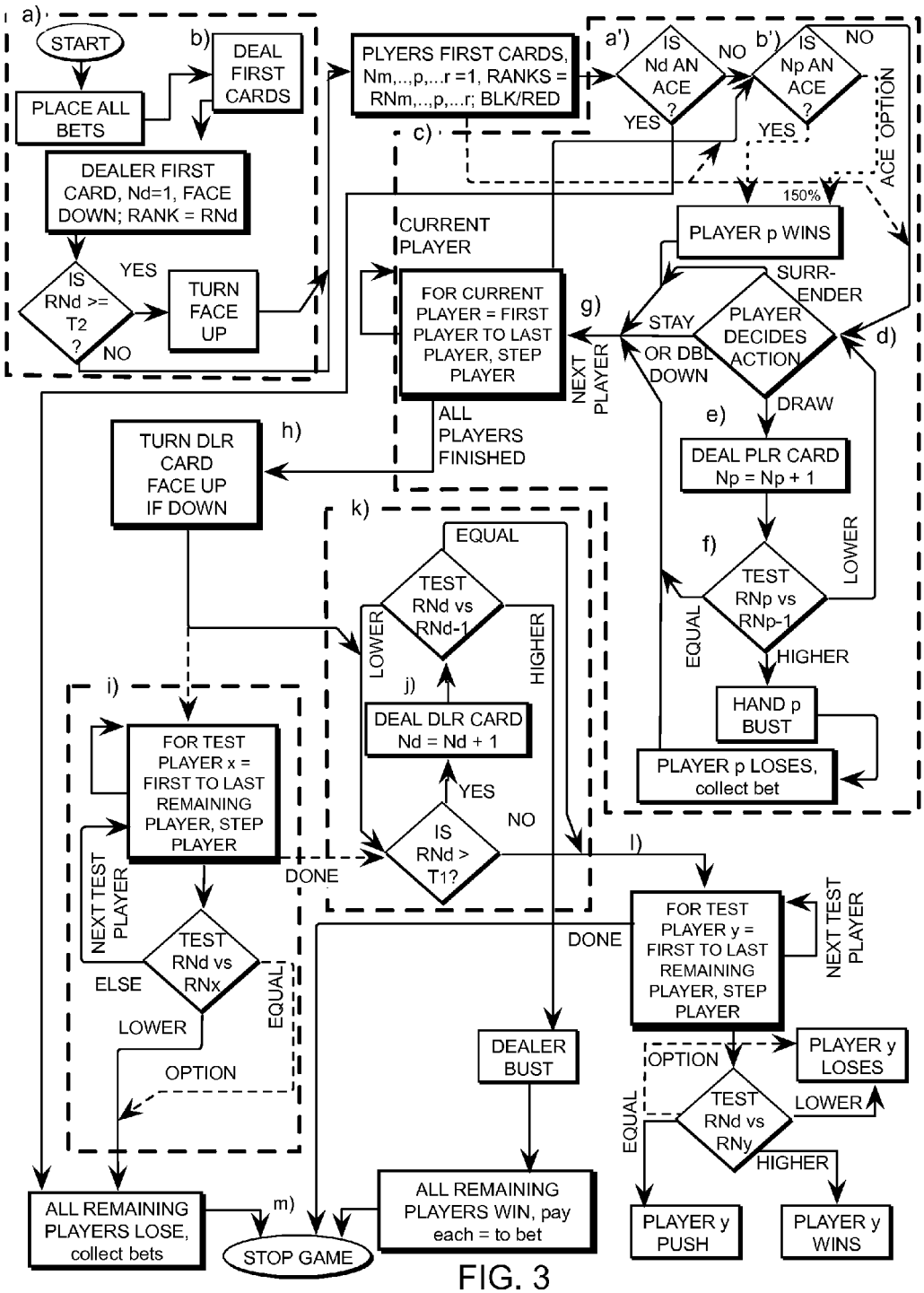
FIG. 3 is a flow chart of the method according to various embodiments, the method comprising dealing a first card to a plurality of players and a dealer, the method further comprising each player placing a bet up to a maximum bet, before the cards are dealt.

In some embodiments, and as illustrated in FIG. 3, the method can further comprise an initial step (a) where each player of the one or more players places a bet up to a maximum bet. If in step (k) the player's most recently dealt card is lower in rank than the dealer's most recently dealt card, the method can comprise declaring the player the winner and paying that player an amount equal to that player's bet. In some embodiments, the player can be paid more or less than the amount of his bet, for example, a player can be paid 2 to 1 on his money, or the player can be paid 1 to 2 on his money, or any desired ratio. If the player's most recently dealt card is higher in rank than the dealer's most recently dealt card, the method can comprise declaring that player a loser and taking that player's bet. In some embodiments, if the player busts, the method can further comprise declaring that player a loser and taking that player's bet. In some embodiments, if the rank of the player's most recently dealt card is equal to the rank of the dealer's most recently dealt card the method can comprise declaring the game a push and either giving the player back his bet, declaring the player a loser and taking the player's bet, declaring the player a loser and taking a portion of his bet, declaring the player a winner and paying the player an amount equal to the player's bet or an amount equal to a portion of his bet.

Figure 4D:
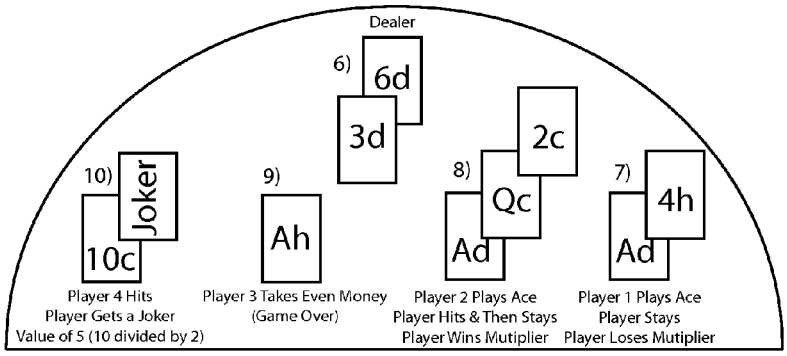
FIG. 4D is a sample diagram of cards on the playing surface, illustrating a possible dealer hand and several possible player outcomes when a player is dealt an Ace or a Joker.

In some embodiments, if the player's first dealt card is an Ace, the method can comprise declaring that player a winner and paying that player an amount equal to the player's bet (FIG. 4D). In some embodiments, if the dealer's most recently dealt card is an Ace, the method can comprise declaring the dealer the winner and collecting all the players' bets at the table, and stopping play. In some embodiments, if the player's most recently dealt card is an Ace, the method can comprise allowing the player an option to be paid an amount equal to the player's bet, or to forego such an "even money" payout and let the player continue playing with the Ace counting as a rank of 14. If the player wins by continuing to play with the Ace counting as a rank of 14, the player can be paid an amount that is greater than the amount of that player's initial bet, for example, an amount that is a multiplier of 150%, 200%, or 300% of the player's initial bet (FIG. 4D).

In some embodiments, the method can comprise receiving a decision from the current player to receive an additional card from the deck, double down, or stay with the cards in the player's hand. If the player decides to double down (FIG. 4A), the amount of the initial bet made by the player can be increased up to double the amount of his initial bet. In some embodiments, the player can be given the option of receiving an additional card, staying with the cards in their hand, or surrendering the cards in their hand. If a player surrenders the method can comprise paying the player a percentage of the player's bet, for example, 25%, 50%, or 75% of the player's bet, and the method can further comprise stopping play for that player.

In some embodiments, the red-colored suits (hearts and diamonds) can be considered higher in rank or lower in rank than the black-colored suits (spades and clubs), such that the lowest rank card is a black ace and the highest rank is a red king, or the lowest rank card is a red ace and the highest rank card is a black king. In this embodiment, instead of the deck of cards comprising 13 ranks of cards Ace through King, the deck comprises 26 ranks of cards, black Ace through red King, or vice versa. In some embodiments, one or more Jokers can be incorporated into a conventional deck of cards, for example, 2 Jokers per each deck of 52 cards used. In some embodiments, if the player or dealer is dealt a Joker, the Joker can represent a rank of ½ of the player's or the dealer's most previously dealt card. For example, if a player's previously dealt card is a 10, the Joker can represent a rank of 5. If the player's most previously dealt card is a King, the Joker can represent a rank of 6.5. If a player or the dealer is dealt a Joker on their first card, the Joker can represent any house-predetermined rank, for example, the rank of 1, 5, 7, 10, or some other desired rank. In some embodiments, if the player's or dealer's previously dealt card is an Ace and the player or dealer takes another card and that next card is a Joker, the Joker can be designated the house-predetermined rank, for example, the rank of 1, 5, 7, 10, or some other desired rank. In some embodiments, if two consecutive jokers are dealt to any player, that player is automatically declared a winner and paid 200% or 300% of his bet. Similarly, if two jokers are consecutively dealt to the dealer, then all players lose, unless any player was also dealt two consecutive jokers.

Each of the method steps, either individually or as a whole, can be incorporated into an electronic game. In some embodiments, the method can be incorporated, for example, on a computer video machine game, on a television monitor, as a home television/computer video game, a video arcade game apparatus, a personal computer system (desktop or portable), a "network computer," a television including or connected to a microprocessor (e.g., a set top box) for Internet or other information access, incorporated into an Internet or intranet environment, or other suitable apparatus. The method of the present teachings can be coded in software and can be configured to be processed by a standard computer processor, for example, a CPU. The software can be stored on a local hard drive, on a flash drive, on a disk, on a removable drive, floppy disk, compact disk, or any other desired storage device. The software can also be stored on a phone, cell phone, MP3 player, calculator, or other portable electronic device desired.

While a particular form of the invention has been illustrated and described, it will be apparent that various modifications can be made without departing from the spirit and scope of the invention. In some embodiments, the method can be modified to increase the player's odds of winning. For example, if the player's most recently dealt card is the same in rank as the dealer's most recently dealt card, at the end of the game, the player can be declared a winner. In some embodiments, the method can be modified to increase the dealer's odds of winning. For example, the method can be modified such that the dealer's hand automatically wins if the dealer's most recently dealt card comprises an Ace. These are just examples of adjusting the settings of the method to either increase the player's chances of winning or to increase the dealer's chances of winning. Further, embodiments that include betting may include a table top surface (not shown) that facilitating playing the game and practicing the method. Such a table top surface may take the general appearance similar to that of a conventional blackjack table, for example. Accordingly, it is not intended that the invention be limited, except as by the appended claims.

The teachings provided herein can be applied to other systems, not necessarily the system described herein. The elements and acts of the various embodiments described above can be combined to provide further embodiments. All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

These and other changes can be made to the invention in light of the above Detailed Description. While the above description details certain embodiments of the invention and describes the best mode contemplated, no matter how detailed the above appears in text, the invention can be practiced in many ways. Details of the system may vary considerably in its implementation details, while still being encompassed by the invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A method for playing a game with a player and a dealer using at least one deck of conventional playing cards, wherein the game is played on a computer comprising a processor, wherein method comprises the processor to perform the steps of:

a) the processor dealing the player and the dealer each—a first card from the deck to the player and a first card from the deck to the dealer, forming a player's hand and a dealer's hand, respectively, at least the dealer's first card being dealt face-down;

b) the processor receiving a decision from the player to either receive an additional card from the deck or to stay with the card in his hand;

c) the processor computing if in step b) the player asks to receive an additional card, and if so, dealing the player the additional card from the deck; otherwise, computing if the player stays, and if so, advancing to step e);

d) the processor computing if the player's additional card is the same rank as the player's previous most recently dealt card, and if so, advancing to step e); otherwise computing if the player's additional card is higher in rank than the player's previous most recently dealt card, and if so, declaring the player's hand a bust and the dealer the winner, and stopping play; otherwise computing if the player's additional card is lower in rank than the player's previous most recently dealt card, and if so, repeating from step b);

e) the processor computing if the dealer's first card is face down, and if so, turning it face up;

f) the processor computing if the dealer's most recently dealt card is lower in rank than the player's most recently dealt card, and if so, declaring the dealer the winner and stopping play; otherwise computing if the dealer's most recently dealt card is equal in rank to the player's most recently dealt card, and if so, declaring the game a push and stopping play;

g) the processor dealing the dealer an additional card from the deck if the dealer's most recently dealt card is above a threshold rank; otherwise advancing to step i);

h) the processor computing if the dealer's additional card has the same rank as the dealer's previous most-recently dealt card, and if so, advancing to step i);

otherwise computing if the dealer's additional card is higher in rank than the dealer's previous most recently dealt card, and if so, declaring the dealer's hand a bust and the player the winner, and stopping play; otherwise computing if the dealer's additional card is lower in rank than the dealer's previous most recently dealt card, and if so, repeating from step f);

i) the processor computing if the player's most recently dealt card is lower than the dealer's most recently dealt card, and if so, declaring the player the winner and stopping play; otherwise computing if the dealer's most recently dealt card is the same rank as the player's most recently dealt card, and if so, declaring the game a push and stopping play; otherwise computing if the dealer's most recently dealt card is lower in rank than that of the player's most recently dealt card, and if so, declaring the dealer the winner and stopping play.

2. The method of claim 1 wherein step a) is:

a) the processor dealing the player and the dealer each a first card from the deck to form a player's hand and a dealer's hand, respectively, the dealer's first card being dealt face-down unless the dealer's first card is equal to or higher than a second threshold rank.

3. The method of claim 1 wherein step f) is:

f) the processor computing if the dealer's most recently dealt card is lower in rank than or equal in rank to the player's most recently dealt card, and if so, declaring the dealer the winner and stopping play;

and step i) is:

i) the processor computing if the player's most recently dealt card is lower than the dealer's most recently dealt card, and if so, declaring the player the winner and stopping play; otherwise computing if the dealer's most recently dealt card is lower in rank than or equal in rank to that of the player's most recently dealt card, and if so, declaring the dealer the winner and stopping play.

4. The method of claim 1 wherein a step a') is included between steps a) and b) as:

a') the processor computing if the player's most recently dealt card is an ace, and if so, declaring the player the winner and stopping play.

5. The method of claim 4 wherein step a') is:

a') the processor computing if the dealer's most recently dealt card is an ace, and if so, declaring the dealer the winner and stopping play; otherwise, computing if the player's most recently dealt card is an ace, and if so, declaring the player the winner and stopping play.

6. A method for playing a game with a plurality of players and a dealer using at least one deck of conventional playing cards, wherein the game is played on a computer comprising a processor, where the method comprises the processor to perform the steps of:

a) the processor dealing each player from a first player to a last player and the dealer each a first card from the deck to form each player's hand and a dealer's hand, at least the dealer's first card being dealt face-down;

b) the processor designating the first player as the current player;

c) the processor receiving a decision from the current player to either receive an additional card from the deck or to stay with the card in his hand;

d) the processor computing if in step c) the current player asks to receive an additional card, and if so, dealing the current player the additional card from the deck; otherwise, computing if the current player stays, and if so, advancing to step f);

e) the processor computing if the current player's additional card has the same rank as the current player's previous most recently dealt card, and if so, advancing to step f); otherwise computing if the current player's additional card is higher in rank than the current player's previous most recently dealt card, and if so, declaring the current player's hand a bust and the current player a loser and advancing to step f); otherwise computing if the current player's additional card is lower in rank than the current player's previous most recently dealt card, and if so, repeating from step c);

f) the processor computing if the current player is not the last player, and if so, designating the next player the current player and repeating from step c);

g) the processor computing if the dealer's first card is face down, and if so, turning it face up;

i) the processor dealing the dealer an additional card from the deck if the dealer's most recently dealt card is above a threshold rank; otherwise advancing to step k);

j) the processor computing if the dealer's additional card has the same rank as the dealer's previous most recently dealt card, and if so, advancing to step k); otherwise computing if the dealer's additional card is higher in rank than the dealer's previous most recently dealt card, and if so, declaring the dealer's hand a bust and each non-losing player remaining a winner, and stopping play; otherwise computing if the dealer's additional card is lower in rank than the dealer's previous most recently dealt card, and if so, repeating from step i);

k) the processor in turn, for each of the remaining non-losing players, computing if the player's most recently dealt card is lower than the dealer's most recently dealt card, and if so, declaring that player a winner and stopping play; otherwise computing if the dealer's most recently dealt card has the same rank as that player's most recently dealt card, and if so, declaring the game a push and stopping play; otherwise computing if the dealer's most recently dealt card is lower in rank than that player's most recently dealt card, and if so, declaring that player a loser;

l) the processor stopping play.

7. The method of claim 6 wherein step a) is:

a) the processor dealing each player from a first player to a last player and the dealer each a first card from the deck to form each player's hand and a dealer's hand, the dealer's first card being dealt face-down unless the dealer's first card is equal to or higher than a second threshold rank.

8. The method of claim 6 further including step h) as:

h) the processor computing if the dealer's most recently dealt card is lower in rank than each of the remaining non-losing players' most recently dealt cards, and if so, declaring each remaining player a loser and stopping play.

9. The method of claim 8 wherein step h) is:

h) the processor computing if the dealer's most recently dealt card is lower in rank than or equal in rank to each of the remaining non-losing players' most recently dealt cards, and if so, declaring each remaining player a loser and stopping play;

and step k) is:

k) the processor in turn, for each of the remaining non-losing players, computing if the player's most recently dealt card is lower than the dealer's most recently dealt card, and if so, declaring that player a winner and stopping play; otherwise computing if the dealer's most recently dealt card is lower in rank than or equal in rank to that player's most recently dealt card, and if so, declaring that player a loser.

10. The method of claim 6 wherein a step a') is included between steps a) and b) as:

a') the processor computing if any player's most recently dealt card is an ace, and if so, declaring that player a winner.

11. The method of claim 10 wherein step a') is:

a') the processor computing if the dealer's most recently dealt card is an ace, and if so, declaring the dealer the winner and stopping play; otherwise, computing if any player's most recently dealt card is an ace, and if so, declaring that player a winner.

12. A method for playing a wagering game with a plurality of players and a dealer using at least one deck of conventional playing cards, wherein the game is played on a computer comprising a processor, wherein method comprises the processor to perform the steps of:

a) the processor receiving from each player a bet up to a maximum bet;

b) the processor dealing each player from a first player to a last player and the dealer each a first card from the deck to form each player's hand and a dealer's hand, at least the dealer's first card being dealt face-down;

c) the processor designating the first player as the current player;

d) the processor receiving a decision from the current player to either receive an additional card from the deck or to stay with the card in his hand;

e) the processor computing if in step d) the current player asks to receive an additional card, and if so, dealing the current player the additional card from the deck; otherwise, computing if the current player stays, and if so, advancing to step g);

f) the processor computing if the current player's additional card has the same rank as the current player's previous most recently dealt card, and if so, advancing to step g); otherwise computing if the current player's additional card is higher in rank than the current player's previous most recently dealt card, and if so, declaring the current player's hand a bust and the current player a loser, collecting the current player's bet, and advancing to step g);

otherwise computing if the current player's additional card is lower in rank than the current player's previous most recently dealt card, and if so, repeating from step d);

g) the processor computing if the current player is not the last player, and if so, designating the next player the current player and repeating from step d);

h) the processor computing if the dealer's first card is face down, and if so, turning it face up;

j) the processor dealing the dealer an additional card from the deck if the dealer's most recently dealt card is above a threshold rank; otherwise advancing to step l);

k) the processor computing if the dealer's additional card has the same rank as the dealer's previous most-recently dealt card, and if so, advancing to step l); otherwise computing if the dealer's additional card is higher in rank than the dealer's previous most-recently dealt card, and if so, declaring the dealer's hand a bust and each non-losing player remaining a winner, paying each winning player an amount equal to his bet, and stopping play; otherwise computing if the dealer's additional card is lower in rank than the dealer's previous most-recently dealt card, and if so, repeating from step j);

l) the processor in turn, for each of the remaining non-losing players, computing if the player's most recently dealt card is lower than the dealer's most recently dealt card, and if so, declaring that player a winner, paying that player an amount equal to his bet, and stopping play; otherwise computing if the dealer's most recently dealt card has the same rank as that player's most recently dealt card, and if so, declaring the game a push and stopping play; otherwise computing if the dealer's most recently dealt card is lower in rank than that player's most recently dealt card, and if so, declaring that player a loser and collecting that player's bet;

m) the processor stopping play.

13. The method of claim 12 wherein step b) is:

b) the processor dealing each player from a first player to a last player and the dealer each a first card from the deck to form each player's hand and a dealer's hand, the dealer's first card being dealt face-down unless the dealer's first card is equal to or above a second threshold.

14. The method of claim 12 further including step i) as:

i) the processor computing if the dealer's most recently dealt card is lower in rank than each of the remaining non-losing players' most recently dealt cards, and if so, declaring each remaining player a loser, collecting each remaining player's bet, and stopping play.

15. The method of claim 14 wherein step i) is:

i) the processor computing if the dealer's most recently dealt card is lower in rank than or equal in rank to each of the remaining non-losing players' most recently dealt cards, and if so, declaring each remaining player a loser, collecting each remaining player's bet, and stopping play;

and step l) is:

l) the processor in turn, for each of the remaining non-losing players, computing if the player's most recently dealt card is lower than the dealer's most recently dealt card, and if so, declaring that player a winner, paying that player an amount equal to his bet, and stopping play; otherwise computing if the dealer's most recently dealt card is lower in rank than or equal in rank to that player's most recently dealt card, and if so, declaring that player a loser and collecting his bet.

16. The method of claim 12 wherein step b') is included between steps b) and c) as:

b') the processor computing if any player's most recently dealt card is an ace, and if so, declaring that player a winner and paying that player an amount equal to his bet.

17. The method of claim 16 wherein step b') is:

b') the processor computing if the dealer's most recently dealt card is an ace, and if so, declaring the dealer the winner, collecting all bets, and stopping play; otherwise, computing if any player's most recently dealt card is an ace, and if so, declaring that player a winner and paying that player an amount equal to his bet.

18. The method of claim 12 wherein a step b') is included between steps b) and c) as:

b') the processor computing if any player's first card is an ace, and if so, allowing that player the option of being paid an amount equal to his bet, or continuing play with the ace counting as a rank 14;

and step l) is:

l) the processor in turn, for each of the remaining non-losing players, computing if the player's most recently dealt card is lower than the dealer's most recently dealt card, and if so, declaring that player a winner, paying that player an amount equal to his bet unless that player's first card was an ace and that player elected in step b') to continue play, in which case paying that player an amount equal to a multiplier of his bet, and stopping play; otherwise computing if the dealer's most recently dealt card has the same rank as that player's most recently dealt card, and if so, declaring the game a push and stopping play; otherwise computing if the dealer's most recently dealt card is lower in rank than that player's most recently dealt card, and if so, declaring that player a loser and collecting that player's bet.

19. The method of claim 12 wherein step d) is:

d) the processor receiving a decision from the current player to either receive an additional card from the deck, double down, or to stay with the cards in his hand;

and wherein step e) is:

e) the processor computing if in step d) the current player asks to receive an additional card or double down, and if so, dealing the current player the additional card from the deck; computing if the current player stays or doubles down, and if so, advancing to step g).

20. The method of claim 12 wherein step d) is:

d) the processor receiving a decision from the current player to either receive an additional card from the deck, surrender, or to stay with the cards in his hand;

and wherein step e) is:

e) the processor computing if in step d) the current player asks to receive an additional card, and if so, dealing the current player the additional card from the deck; computing if the current player stays, and if so, advancing to step g); otherwise, computing if the current player surrenders, and if so, paying the player 50% of his bet and stopping play for that player.

21. The method of claim 12 wherein step f) is:

f) the processor computing if the current player's additional card has the same rank as the current player's previous most recently dealt card, and if so, receiving a decision from the current player to either split his hand into two separate hands to be played as though he is two separate players if he has only been dealt two cards, or to stay with the cards in his hand; otherwise computing if the current player's additional card is higher in rank than the current player's previous most recently dealt card, and if so, declaring the current player's hand a bust and the current player a loser, collecting the current player's bet, and advancing to step g); otherwise computing if the current player's additional card is lower in rank than the current player's previous most recently dealt card, and if so, repeating from step d).

22. The method of claim 12 wherein one or more jokers are included in the deck, and wherein when a joker is dealt as the first card in a player's hand the joker may be designated a predetermined rank, and wherein when a joker is dealt to a player's hand after the player's first card, the joker is designated as one-half of the rank of the player's most previously dealt card, and wherein the processor computing if the player's first card is an ace and the player's second card is a joker, and if so, the joker may be designated the predetermined rank.

* * * * *